US007951012B1

(12) United States Patent
Burriss

(10) Patent No.: US 7,951,012 B1
(45) Date of Patent: May 31, 2011

(54) PIVOTING SWING

(76) Inventor: C. Scott Burriss, Chapin, SC (US)

( * ) Notice: Subject to any disclaimer, the term of this patent is extended or adjusted under 35 U.S.C. 154(b) by 214 days.

(21) Appl. No.: 12/378,238

(22) Filed: Feb. 12, 2009

(51) Int. Cl.
*A63G 9/12* (2006.01)
*A63G 9/02* (2006.01)

(52) U.S. Cl. ..... 472/118; 472/125

(58) Field of Classification Search ..... 472/118–125; 248/226.11, 228.1, 231.9, 231.91; 297/273, 297/274
See application file for complete search history.

(56) References Cited

U.S. PATENT DOCUMENTS

| | | | | |
|---|---|---|---|---|
| 1,538,828 | A * | 5/1925 | Lammermann | 472/20 |
| 2,513,021 | A * | 6/1950 | Harrold | 472/122 |
| 3,663,016 | A * | 5/1972 | Morris | 472/33 |
| 4,014,540 | A * | 3/1977 | Caulkins | 472/14 |
| 5,413,298 | A * | 5/1995 | Perreault | 248/228.6 |
| 2009/0105002 | A1 * | 4/2009 | Kahn et al. | 472/118 |

* cited by examiner

*Primary Examiner* — Kien T Nguyen
(74) *Attorney, Agent, or Firm* — Renner, Kenner, Greive, Bobak, Taylor & Weber

(57) ABSTRACT

A pivoting swing maintains a support member that is rotatably attached to pivot assembly allows the support member to be rotated in any desired position. The pivot assembly includes a lock assembly that allows the position of the support member to be retained once a desired position has been found. Flexible suspension members attach the support member to the pivot assembly, thereby allowing the support member to swing back and forth once the support member has been rotated to a desired position.

16 Claims, 5 Drawing Sheets

PIVOTING SWING

TECHNICAL FIELD

The present invention is generally directed to recreational swings. In particular, the present invention is directed to a pivoting swing that is able to be rotated in any direction. More particularly, the present invention is directed to a pivoting swing that can be locked into position once it has been rotated into a desired position.

BACKGROUND ART

Recreational swings, such as porch swings, generally comprise a support structure, such as a seat, that is suspended by various chains or cables that span between the support structure of the swing and various hooks or other retainers that are affixed to a ceiling or other overhead support member. Thus, because such swings are rigidly affixed into the framework of a home or other structure, the users must identify the most desirable orientation of the swing prior to its installation. For example, users must weigh several considerations prior to installation of the swing, such as the position of the sun, whether the swing will be placed in a windward or leeward region, the aesthetic view of surrounding landscape, as well as other considerations. While the user may have taken many of these considerations into account prior to its installation, circumstances may exist where the user desires to have other points of view while using the swing. For example, during certain parts of the day, the sun may be directly in the user's field of view, and as such, the user may desire to reposition him or herself so that he or she is shielded from the sun. Unfortunately, in order to alter the position of current swings, the user must physically remove and reinstall the swing in a new location, which is generally impractical.

Therefore, there is a need for a pivoting swing that can be rigidly attached to a structure, such as a ceiling, whereby a flexibly-suspended support member can be rotated 360 degrees to a desired position, while allowing the support member to be swung back and forth. In addition, there is a need for a pivoting swing, whereby the pivoting support member can be selectively locked in position, so as to prevent further rotation.

SUMMARY OF THE INVENTION

In light of the foregoing, it is a first aspect of the present invention to provide a pivoting swing for attachment to an overhead member, the pivoting swing comprising a pivot assembly adapted to be attached to the overhead member, a carrying member pivotably attached to said pivot assembly, and a support member coupled to said carrying member by at least one flexible suspension member, wherein said support member is moved when said carrying member is rotated.

Yet another aspect of the present invention is to provide a pivoting swing for attachment to an overhead member comprising a lock plate adapted to be attached to the overhead member, said lock plate maintaining at least one lock aperture; a shaft received through said lock plate and adapted to be attached to the overhead member; a bearing assembly adjacent said lock plate and carried by said shaft; a rotating arm rotatably carried by said bearing assembly, said rotating arm carrying a lock pin to selectively engage said at least one lock aperture to lock said rotating arm in place; a carrying member received by said rotating arm, wherein said rotating arm and said carrying member are supported by said shaft; and a support assembly attached to said carrying member by at least one flexible suspension member to allow said support assembly to move forward and backward.

BRIEF DESCRIPTION OF THE DRAWINGS

These and other features and advantages of the present invention will become better understood with regard to the following description, appended claims, and accompanying drawings where:

BEST MODE FOR CARRYING OUT THE INVENTION

Figure 1:
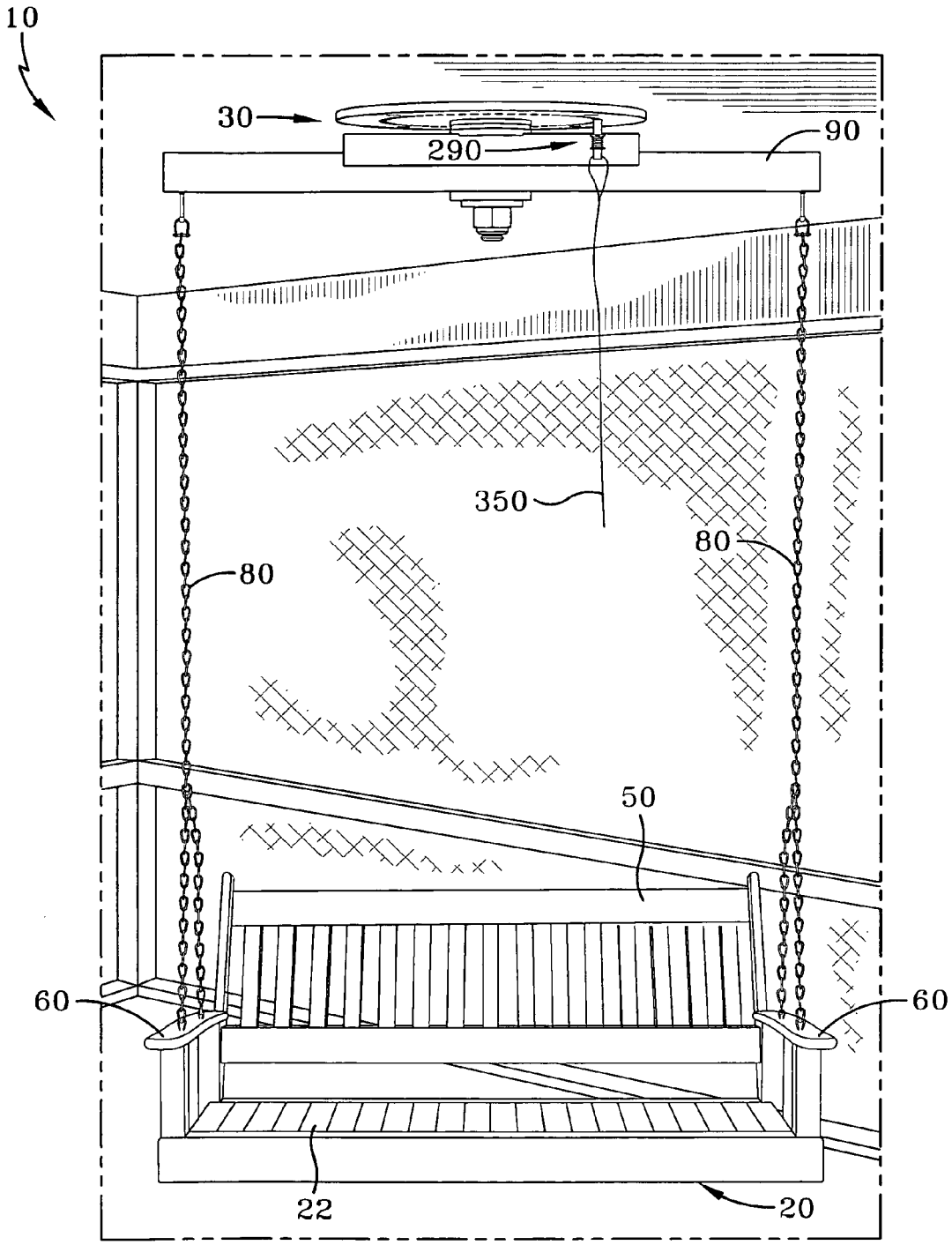
FIG. 1 is a perspective view of a pivoting swing in accordance with the concepts of the present invention.
Figure 2:
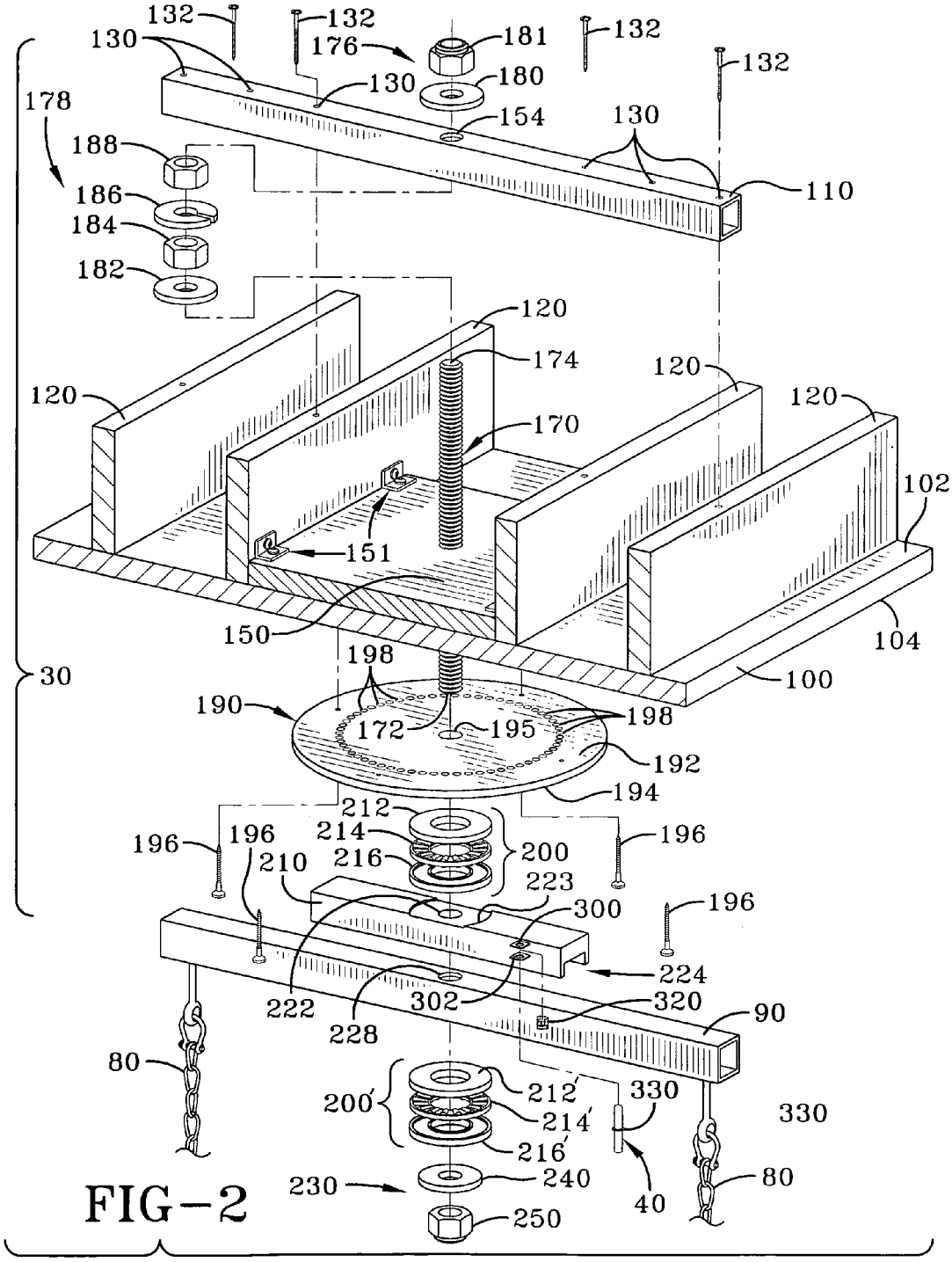
FIG. 2 is an exploded view of the pivoting swing in accordance with the concepts of the present invention.
Figure 3:
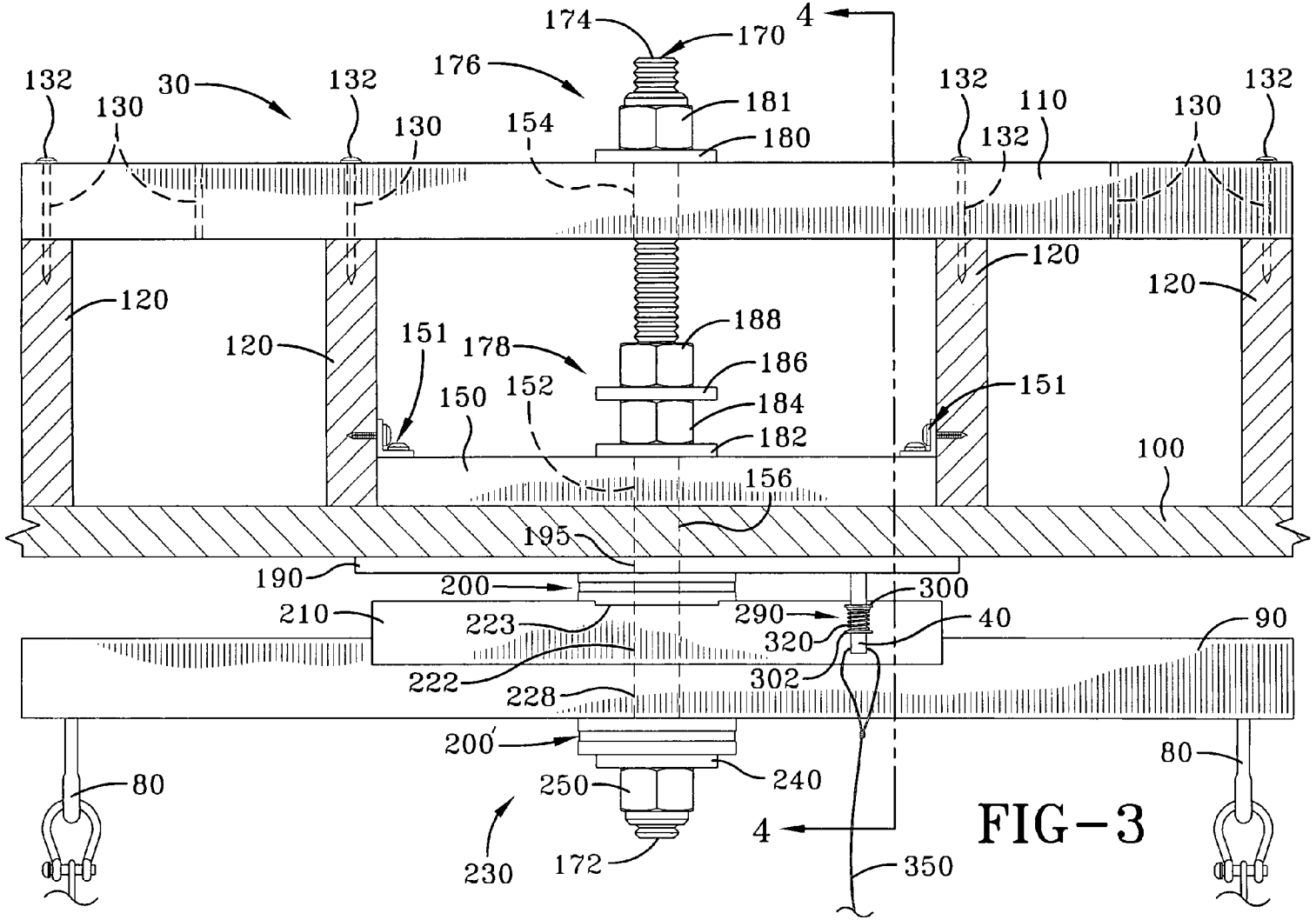
FIG. 3 is a front elevational view of the pivot assembly maintained by the pivoting swing in accordance with the concepts of the present invention.
Figure 4:
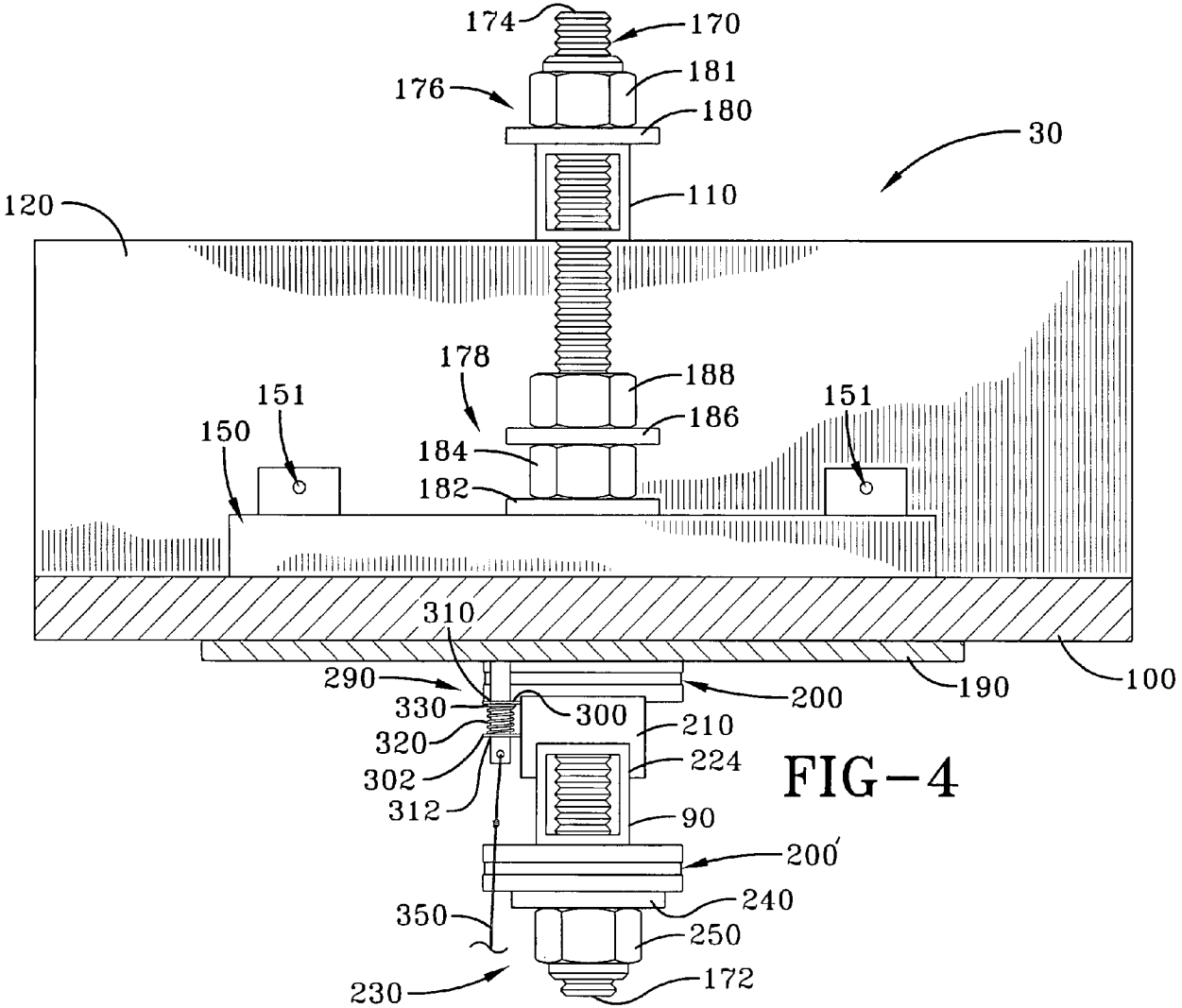
FIG. 4 is a side elevational view of the pivot assembly shown in FIG. 3 in accordance with the concepts of the present invention.
Figure 5:
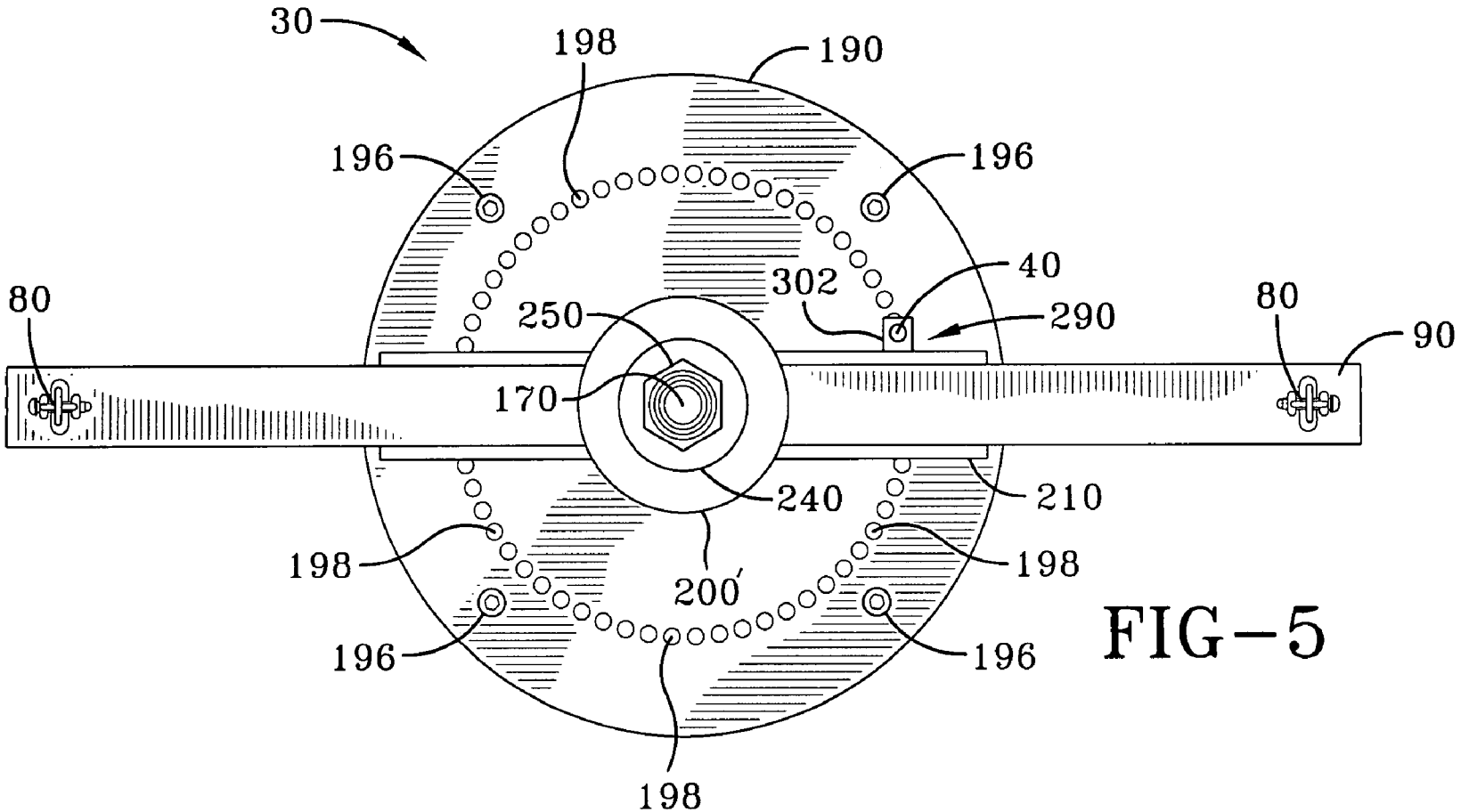
FIG. 5 is a bottom plan view of the pivot assembly in accordance with the concepts of the present invention.

A pivoting swing is generally referred to by the numeral 10, as shown in FIG. 1 of the drawings. The swing 10 includes a support assembly 20 that is suspended from a pivot assembly 30, which allows the support assembly 20 to be rotated 360 degrees to a desired position. The support assembly 20 comprises a support member 22 that is suitable for the user to sit upon, while allowing the user to swing backward and forward. As such, the swing 10 allows the user to rotate the position of the support assembly 20 about a 360-degree range, and once in position, is permitted to swing forward and backward. The pivot assembly 30 also includes a locking pin 40 that allows the user of the swing 10 to selectively lock the support assembly 20 in place once it has been rotated into a desired position.

The support assembly 20 comprises the support member 22, which allows users to sit thereupon. The support member 22 may also include a back member 50 that provides support to the user when he or she is seated upon the support member 22. The support assembly 20 may also include various extension members 60, such as arm supports, that are attached to the support member 22 and/or to the back 50. Attached at one end to either of the support member 22 or the back member 50 are suspension members 80 that are attached at another end to a carrying member 90, which serves to carry the support assembly 20. The suspension members 80 comprise any suitable length and may comprise a chain, cable, cord, flexible band, or any other means suitable for flexibly carrying the support assembly 20. It should also be appreciated that the suspension members 80 are configured so as to allow a user seated upon the support assembly 20 to freely swing or translate forward and backward. Additionally, the carrying member 90 comprises any suitable section of material, such as steel, aluminum, or plastic, that is capable of carrying the weight of the user when seated upon the support member 22. Moreover, the carrying member 90 may take on any suitable shape, including rectilinear, curvilinear, or a combination of both.

The pivot assembly 30, shown in FIGS. 2-5, is configured to be mounted to an existing ceiling member 100, having an inner surface 102 opposite an outer surface 104. The ceiling member 100 is spaced apart from a transverse reinforcement member 110 maintained by the pivot assembly 30 by a plurality of beam members 120, such as the joists typically found in a house. That is, the reinforcement member 110 is disposed upon the beam members 120 and is oriented at a generally right angle thereto. To retain the reinforcement member 110 to the beam members 120, the reinforcement member 110 includes one or more spaced apertures 130 along its length, which are dimensioned to receive suitable fasteners 132, such as wood screws, therethrough for receipt by the beam members 120. In one aspect, the apertures 130 maintained by the reinforcement member 110 may be spaced apart at varying intervals to accommodate the attachment of the reinforcement member 110 to beam members 120 that may be spaced at various intervals as well. The pivot assembly 30 also includes a support section 150 that is disposed in the region between two of the beam members 120 and placed adjacent the inner surface 102 of the ceiling member 100, using any suitable fastener, such as brackets 151, as well as adhesive, screws, nails, and the like.

In addition, the support section 150 maintains an aperture 152 that is axially aligned with an aperture 154 maintained by the reinforcement member 110 and an aperture 156 that is maintained by the ceiling member 100. As such, the apertures 152, 154, and 156 are configured so that they are coaxial with one another, so as to receive a shaft 170 having ends 172 and 174 therethrough. While the shaft 170 is shown with threads throughout its length, the shaft 170 may be configured with threads only in the regions where they are needed for attachment purposes to be discussed.

To retain the shaft 170 to the reinforcement member 110 and to the support section 150, a pair of retention assemblies 176 and 178, respectively, are used. In particular, the retention assembly 176, which supports the shaft 170 upon the reinforcement member 110, comprises a flat washer 180 that is disposed adjacent to the reinforcement member 110 and a locking nut 181 that is threadably received by complementary threads maintained by the shaft 170. The retention assembly 178, which supports the shaft 170 upon the support section 150 comprises a flat washer 182 that is disposed adjacent to the support section 150, a nut 184 that is disposed adjacent to the flat washer 182, a locking washer 186 that is disposed adjacent to the nut 184, and a nut 188 that is threadably received by complementary threads (not shown) maintained by the shaft 170. It should also be appreciated that the retention assemblies 176 and 178 may comprise any other suitable means of retaining the shaft 170 to the reinforcement member 110 and to the ceiling member 100.

A lock plate 190 having an inner surface 192 opposite an outer surface 194 maintains a centrally-disposed aperture 195 that receives the shaft 170 therethough. The lock plate 190 is retained, such that its inner surface 192 is adjacent to the outer surface 104 of the ceiling member 100, by any suitable fasteners 196, such as screws, which are threadably received by the ceiling member 100 and/or the support section 150. The lock plate 190 also includes a plurality of lock apertures 198 that are configured to receive the lock pin 40 to be discussed.

A bearing assembly 200 is carried upon the shaft 170 between the outer surface 194 of the lock plate 190 and a rotating arm 210. Specifically, the bearing assembly 200 comprises a washer 212 disposed adjacent the outer surface of the lock plate 190; a bearing 214, such as a thrust bearing, disposed adjacent washer 212; and a thrust washer 216 disposed adjacent thrust bearing 214. As such, the bearing assembly 200 enables the rotating arm 210 to freely pivot in a 360-degree range with respect to the lock plate 190. It should be appreciated that the thrust washer 216 is configured to engage the surface of the rotating arm 210.

The rotating arm 210 maintains a centrally-disposed aperture 222 within a bearing retainer 223 to receive the shaft 170 therethrough. The bearing retainer 223 is dimensioned to retain the thrust washer 216 therein so that the rotating arm 210 is able to freely rotate. The rotating arm 210 also maintains a channel 224 that is dimensioned to receive the cross-sectional dimension of the carrying member 90 therein. For example, as shown clearly in FIG. 4, the channel 224 may be configured to have a rectangular cross-section, which is suitable for receiving the rectangular cross-section of the carrying member 90. And while a rectangular cross-section is discussed for use with the rotating arm 210 and the carrying member 90, such should not be construed as limiting, as any other suitable complementary cross-sectional shape may be used. As such, the channel 224 imparts the rotating movement of the rotating arm 210 to the carrying member 90.

The carrying member 90, which is received within the channel 224 of the rotating arm 210, maintains an aperture 228 that receives the shaft 170 therethrough. Also carried by the shaft 170 is a bearing assembly 200' that, together with the bearing assembly 200, enables the carrying member 90 to freely rotate about a 360-degree range. The bearing assembly 200' is comprised of washer 212' that is configured to engage the surface of the carrying member 90; a bearing 214', such as a thrust bearing, disposed adjacent washer 212'; and a thrust washer 216' disposed adjacent thrust bearing 214'. The bearing assembly 200' is retained upon the shaft 170 by a fastening assembly 230 attached to the end 172 of the shaft 170. Specifically, the fastening assembly 230 comprises a flat washer 240 that is disposed adjacent to the bearing assembly 200' and a nut 250 that is threadably received by the shaft 170. As such, when the nut 250 is tightened, a compressive force is applied between the carrying member 90 and the rotating arm 210, so as to retain the carrying member 90 within the channel 224 of the rotating arm 210. Furthermore, by tightening the nut 250, force is generated between the retention assemblies 176 and 178 that are respectively carried upon the reinforcement member 110 and the ceiling member 100 to further anchor the swing 10.

It should be appreciated that while the rotating arm 210 and the carrying member 90 are shown to extend at a substantially right angle from the shaft 170, such should not be construed as limiting, as the rotating arm 210 and/or carrying member 90 may extend at other angles and orientations.

To lock the position of the carrying member 90 with respect to the lock plate 190, a lock assembly 290 is maintained by the rotating arm 210. The lock assembly 290 includes a pair of spaced protrusions 300 and 302 that include respective apertures 310,312 and a spring 320 that is axially aligned therewith to receive the pin 40 therethrough. The pin 40 includes one or more tabs 330, such as a tab that circumscribes the pin 40, which engages the spring 320, so as to bias the lock pin 40 in a locked state, such that it is received within one the lock apertures 198 maintained by the lock plate 190, thus locking the position of the carrying arm 90 to the lock plate 190. As a result, the support assembly 20 is not permitted to rotate about its 360-degree range of travel. It should be appreciated that the lock apertures 198 are disposed in the lock plate 190 so that they are aligned with the arcuate or curved path that lock pin 40 travels when the rotating arm 210 is moved.

Thus, when the user desires to pivot or rotate the support assembly 20, he or she pulls on a line 350 attached to the lock pin 40 to overcome the bias of the spring 320 so that the pin 40 is placed in an unlocked state, such that it is no longer received within the lock aperture 198, and whereby the carrying member 90 is freely rotatable about its 360-degree range. Once a desired position is found, the line 350 is released so that the lock pin 40 is again received within one of the lock apertures 198, so as to prevent the carrying member 90 from further rotation. As such, a user seated upon the support assembly 20 of the swing 10 can swing both forward and backward, as well as pivot about a 360-degree range to obtain the most desirable vantage point.

It should also be appreciated that the lock pin 40 may also be configured to be permanently placed in an unlocked position using known techniques so that it does not engage any of the lock apertures 198, thereby allowing the carrying member 90 to freely rotate in a 360-degree range at all times.

Therefore, one advantage of the present invention is that a pivoting swing of the present invention allows the user to rotate a support assembly about a 360-degree range to achieve a plurality of different vantage points without the need of reinstalling the swing in a new position. In addition, another advantage of the pivoting swing of the present invention is that users can selectively lock a carrying member that suspends the support assembly once a desired vantage point is found. Furthermore, another advantage of the pivoting swing is that users can lock the carrying member that suspends the support assembly prior to getting into or out of the swing. Still another advantage of the pivoting swing of the present invention is that users can freely rotate the support assembly to a desired position, where it can be locked in place.

Thus, it can be seen that the objects of the invention have been satisfied by the structure and presented above. While in accordance with the Patent Statutes, only the best mode and preferred embodiment have been presented and described in detail, it being understood that the invention is not limited thereto or thereby. Accordingly, for an appreciation of the true scope and breadth of the invention, reference should be made to the following claims.

What is claimed is:

1. A pivoting swing for attachment to an overhead member, the pivoting swing comprising:

a pivot assembly adapted to be attached to the overhead member, wherein said pivot assembly includes a rotating arm that receives a carrying member pivotably attached to said pivot assembly, said rotating arm rotating upon a bearing assembly maintained by said pivot assembly; and a support member coupled to said carrying member by at least one flexible suspension member, wherein said support member is moved when said carrying member is rotated.

2. The pivoting swing of claim 1, wherein said rotating arm receives said carrying member in a channel maintained thereby.

3. The pivoting swing of claim 1, wherein said rotating arm, said carrying member, and said bearing assembly are supported upon a shaft.

4. The pivoting swing of claim 3, wherein said shaft is attached to the overhead member.

5. The pivoting swing of claim 3, wherein said rotating arm extends at a substantially right angle to said shaft.

6. The pivoting swing of claim 5, wherein said carrying member extends at a substantially right angle to said shaft.

7. The pivoting swing of claim 3, wherein said shaft is attached to a reinforcement member adapted to extend transversely across beam members extending from the overhead member.

8. A pivoting swing for attachment to an overhead member, the pivoting swing comprising:

a pivot assembly adapted to be attached to the overhead member, wherein said pivot assembly includes a rotating arm that receives a carrying member pivotably attached to said pivot assembly, said rotating arm rotating upon a bearing assembly maintained by said pivot assembly, said pivot assembly including a lock plate, maintaining at least one lock aperture to receive a lock pin carried by a lock assembly attached to said rotating arm to selectively lock said carrying member in place; and a support member coupled to said carrying member by at least one flexible suspension member, wherein said support member is moved when said carrying member is rotated.

9. The pivoting swing of claim 8, wherein said lock pin is spring biased.

10. A pivoting swing for attachment to an overhead member comprising:

a lock plate adapted to be attached to the overhead member, said lock plate maintaining at least one lock aperture;

a shaft received through said lock plate and adapted to be attached to the overhead member;

a bearing assembly adjacent said lock plate and carried by said shaft;

a rotating arm rotatably carried by said bearing assembly, said rotating arm carrying a lock pin to selectively engage said at least one lock aperture to lock said rotating arm in place;

a carrying member received by said rotating arm, wherein said rotating arm and said carrying member are supported by said shaft; and a support assembly attached to said carrying member by at least one flexible suspension member to allow said support assembly to move forward and backward.

11. The pivoting swing of claim 10, wherein said rotating arm receives said carrying member in a channel maintained thereby.

12. The pivoting swing of claim 10, wherein said rotating arm extends at a substantially right angle to said shaft.

13. The pivoting swing of claim 12, wherein said carrying member extends at a substantially right angle to said shaft.

14. The pivoting swing of claim 10, wherein said bearing assembly comprises a thrust bearing.

15. The pivoting swing of claim 10, wherein said lock pin is spring biased.

16. The pivoting swing of claim 10, further comprising a reinforcement member adapted to extend transversely across beam members extending from the overhead member, said reinforcement member attached to said shaft.

* * * * *